US007987525B2

(12) United States Patent
Summers et al.

(10) Patent No.: US 7,987,525 B2
(45) Date of Patent: Aug. 2, 2011

(54) HELMET

(75) Inventors: Justin Summers, Rigby, ID (US); Robert Keathley, Rigby, ID (US); Paul Webber, Rigby, ID (US)

(73) Assignee: KLIM, Rigby, ID (US)

( * ) Notice: Subject to any disclaimer, the term of this patent is extended or adjusted under 35 U.S.C. 154(b) by 978 days.

(21) Appl. No.: 11/771,751

(22) Filed: Jun. 29, 2007

(65) Prior Publication Data

US 2008/0250549 A1 Oct. 16, 2008

Related U.S. Application Data

(60) Provisional application No. 60/911,835, filed on Apr. 13, 2007.

(51) Int. Cl.
*A63B 71/10* (2006.01)

(52) U.S. Cl. ..... 2/425; 2/410

(58) Field of Classification Search ..... 2/6.3, 6.5, 2/6.7, 171.3, 410, 411, 421, 424, 416, 432, 2/425

See application file for complete search history.

(56) References Cited

U.S. PATENT DOCUMENTS 3,223,086 A * 12/1965 Denton ..... 128/201.24
3,860,966 A * 1/1975 Brown et al. ..... 2/415
3,925,821 A * 12/1975 Lewicki ..... 2/425
4,054,953 A * 10/1977 De Barsy ..... 2/414
4,075,714 A * 2/1978 Ryder et al. ..... 2/6.3
4,404,690 A * 9/1983 Farquharson ..... 2/420
4,434,514 A * 3/1984 Sundahl et al. ..... 2/425
4,519,099 A * 5/1985 Kamiya et al. ..... 2/424
4,539,715 A * 9/1985 Clement ..... 2/420
4,599,752 A * 7/1986 Mitchell ..... 2/425
4,622,700 A * 11/1986 Sundahl ..... 2/425
4,653,123 A * 3/1987 Broersma ..... 2/425
4,700,411 A * 10/1987 Kawasaki et al. ..... 2/425
4,993,082 A * 2/1991 Gentes et al. ..... 2/410
4,996,724 A * 3/1991 Dextrase ..... 2/411
5,010,598 A * 4/1991 Flynn et al. ..... 2/410
5,058,212 A 10/1991 Kamata
5,093,937 A * 3/1992 Kamata ..... 2/424
5,093,938 A 3/1992 Kamata
5,136,728 A 8/1992 Kamata
5,272,773 A * 12/1993 Kamata ..... 2/421
5,394,566 A * 3/1995 Hong ..... 2/424
5,448,780 A * 9/1995 Gath ..... 2/424
5,461,731 A 10/1995 Shida
5,734,994 A * 4/1998 Rogers ..... 2/411
5,867,840 A 2/1999 Hirosawa et al.
5,937,446 A * 8/1999 Fallert ..... 2/412

(Continued)

*Primary Examiner* — Katherine Moran
*Assistant Examiner* — Richale L Quinn
(74) *Attorney, Agent, or Firm* — Zarian Midgley & Johnson PLLC

(57) ABSTRACT

A helmet for use by an operator or rider of a motorized vehicle, such as a motorcycle or snowmobile, includes a ventilation system with an air intake subsystem, an air diffusion subsystem, and an air exhaust subsystem. The air intake subsystem includes a plurality of air intake vents located in the outer shell of the helmet, as well as a plurality of air intake holes located within the foam liner of the helmet. The air diffusion subsystem includes a plenum located between an upper portion and a lower portion of the foam liner, which can act as a pressure chamber to forcefully direct air onto the user's head. The air exhaust subsystem includes one or more exhaust ports that create a vacuum near the back of the helmet to draw large volumes of airflow through the helmet as it travels forward.

19 Claims, 6 Drawing Sheets

U.S. PATENT DOCUMENTS 5,996,128 A * 12/1999 Yanagihara ..... 2/422
6,070,271 A * 6/2000 Williams ..... 2/412
6,263,513 B1 * 7/2001 Murakami ..... 2/171.3
6,339,849 B1 * 1/2002 Nelson et al. ..... 2/425
6,405,382 B2 * 6/2002 Shida ..... 2/171.3
6,421,841 B2 7/2002 Ikeda
6,453,476 B1 * 9/2002 Moore, III ..... 2/412
6,654,969 B2 12/2003 Taniuchi
6,904,618 B2 * 6/2005 Musal ..... 2/425
6,910,228 B2 * 6/2005 Tanaka ..... 2/424
6,957,447 B1 * 10/2005 Broersma ..... 2/9
D583,102 S * 12/2008 Summers et al. ..... D29/106
7,475,434 B2 * 1/2009 Ambuske et al. ..... 2/425
7,546,645 B2 * 6/2009 Goodhand et al. ..... 2/424
2002/0120978 A1 * 9/2002 Moore, III ..... 2/412
2006/0248630 A1 * 11/2006 Bullock et al. ..... 2/421
2008/0052808 A1 * 3/2008 Leick et al. ..... 2/411
2009/0178184 A1 * 7/2009 Brine et al. ..... 2/414

* cited by examiner

HELMET

RELATED APPLICATIONS

The present application claims priority to U.S. Provisional Patent Application No. 60/911,835, entitled "Helmet" and filed Apr. 13, 2007. This application is incorporated herein by reference in its entirety.

BACKGROUND

The present application relates generally to helmets and more specifically to helmet ventilation systems.

Use of head protection is often recommended and sometimes required by law while operating certain motorized vehicles, such as motorcycles or snowmobiles. Accordingly, helmets are available in a variety of styles to provide protection from serious head injuries during accidents. However, existing helmets that satisfy applicable safety standards frequently exhibit undesirable heat retention properties, which tend to trap heat around a user's head.

Under such conditions, as the user's head becomes hotter, the body's cooling system attempts to correct the problem by increasing blood flow to the head and generating perspiration for evaporative cooling. Nevertheless, existing helmets tend to counteract the body's cooling system by covering and limiting airflow around the head, making it difficult for the body to rid itself of heat. As a result, users typically become increasingly uncomfortable as they continue to use such helmets, and ultimately their performance suffers.

Some designers have attempted to alleviate the heat retention problems common among existing helmets through the use of ventilation holes and channels within the helmet. Such attempts have proven inadequate, however, primarily because they have not provided enough airflow through the helmet to adequately cool the user's head. In addition, such previous attempts have typically failed to provide sufficient exhaust to allow for adequate cooling.

SUMMARY

The above-mentioned drawbacks associated with existing helmets are addressed by embodiments of the present application, which will be understood by reading and studying the following specification.

In one embodiment, a ventilation system is provided for a helmet comprising a hard outer shell and an impact-absorbing liner. The ventilation system comprises an air intake subsystem comprising a plurality of air intake vents located in the outer shell and a plurality of air intake holes located in the liner. The ventilation system further comprises an air diffusion subsystem comprising a plurality of channels extending throughout the liner and a plenum located between an upper portion of the liner and a lower portion of the liner, the upper portion of the liner comprising a plurality of air intake holes configured to direct airflow captured by one or more of the air intake vents into the plenum. The ventilation system further comprises an air exhaust subsystem comprising at least one exhaust port located in the outer shell and a corresponding exhaust hole located in the liner.

In another embodiment, a helmet comprises a hard outer shell with a plurality of air intake vents, including one or more rear intake vents located in an upper rear quadrant of the helmet and angled forward to capture air flowing over the helmet as it travels forward. The helmet further comprises an impact-absorbing liner within the hard outer shell, the liner comprising a plurality of air diffusion channels and a plurality of air intake holes aligned with the air intake vents. The air intake vents, air intake holes, and air diffusion channels are configured to direct airflow onto a user's head while the helmet is in use.

In another embodiment, a helmet comprises an outer shell comprising a fiber reinforced composite material and an impact-absorbing liner within the outer shell, the liner comprising Expanded Polystyrene having a thickness of at least about 20 mm. At least one edge of the impact-absorbing liner is coated with a protective border comprising polyurethane. The protective border extends to a distance of at least about 20 mm from the nearest edge of the impact-absorbing liner, at a depth of at least about 0.05 mm.

These and other embodiments of the present application will be discussed more fully in the description. The features, functions, and advantages can be achieved independently in various embodiments of the claimed invention, or may be combined in yet other embodiments.

BRIEF DESCRIPTION OF THE DRAWINGS

The accompanying drawings, which are incorporated in and constitute a part of this specification, illustrate exemplary embodiments of the present application.

Like reference numbers and designations in the various drawings indicate like elements.

DETAILED DESCRIPTION

In the following description, reference is made to the accompanying drawings that form a part thereof, and in which is shown by way of illustration specific exemplary embodiments in which the invention may be practiced. These embodiments are described in sufficient detail to enable those skilled in the art to practice the invention, and it is to be understood that modifications to the various disclosed embodiments may be made, and other embodiments may be utilized, without departing from the spirit and scope of the present invention. The following detailed description is, therefore, not to be taken in a limiting sense.

Figure 1:
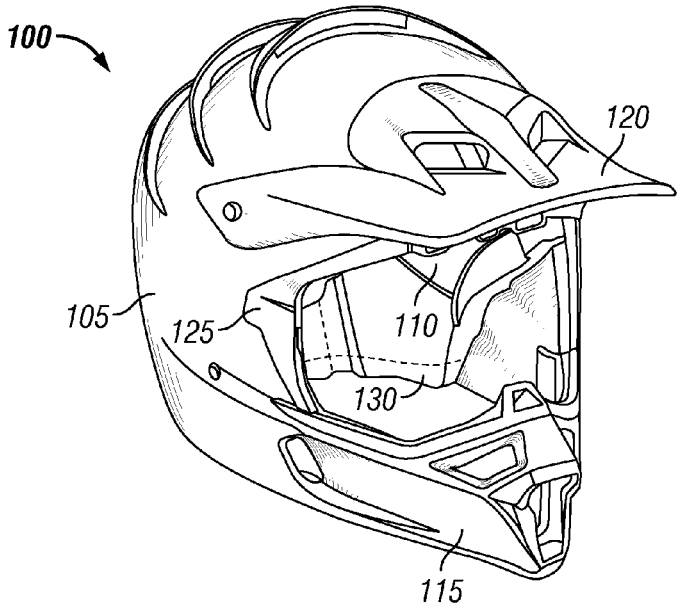
FIG. 1 is a perspective view of one exemplary embodiment of a helmet with improved ventilation characteristics.
Figure 2:
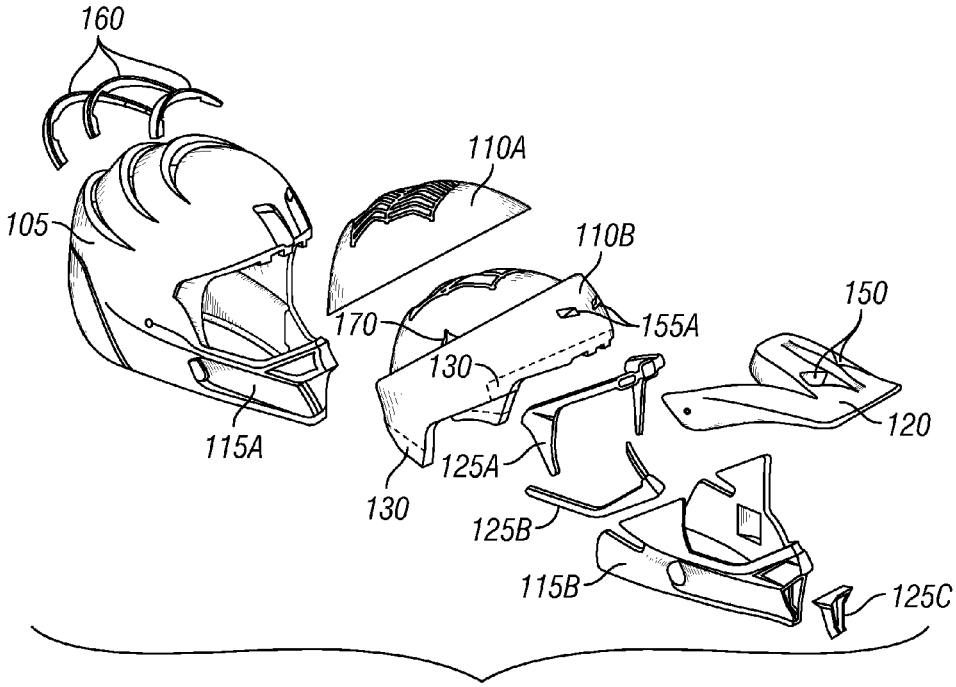
FIG. 2 is an exploded view of the helmet shown in FIG. 1.

FIG. 1 is a perspective view of one exemplary embodiment of a helmet 100 with improved ventilation characteristics. FIG. 2 is an exploded view of the helmet 100 shown in FIG. 1. In the illustrated embodiment, the helmet 100 comprises an outer shell 105, an impact-absorbing liner 110, a chin bar 115, and a visor 120. These components surround and protect the user's head from injury while the helmet 100 is in use. In some embodiments, as shown in FIG. 2, the chin bar 115 comprises a chin bar outer shell 115A and a chin bar liner 115B.

The helmet 100 also comprises a variety of trim components 125 that primarily enhance the overall aesthetic appeal of the helmet 100. For example, as shown in FIG. 2, the helmet 100 may comprise an upper eye port trim piece 125A, a lower eye port trim piece 125B, and a mouthpiece 125C. In the illustrated embodiment, the trim components 125 can provide a resting place for a goggle strap (not shown), in addition to enhancing the aesthetics of the helmet 100. The various components shown in FIG. 2 can be assembled together to form the helmet 100, as shown in FIG. 1, using a variety of well-known suitable assembly techniques.

In some embodiments, the outer shell 105 is constructed from a fiber reinforced composite material comprising multiple sheets or plies. Using customized design and construction techniques known as "zonal fiber select construction," the helmet 100 can be fabricated to have different characteristics in different regions. For example, the thickness of individual sheets of material can be varied in different regions of the helmet 100, as well as the particular fiber strain woven into the sheet stock. During construction, each component of the helmet 100 can be measured carefully and a controlled amount of resin applied. These zonal fiber select construction techniques can advantageously increase the safety characteristics of the helmet 100 without increasing its bulk or weight. In some embodiments, the weight of the helmet 100 falls within the range of about 1250 grams to about 1600 grams, preferably less than about 1450 grams.

The liner 110 is constructed from an impact-absorbing material, such as Expanded Polystyrene ("EPS"), which is designed to crush upon impact to dissipate the impact energy and protect the head of the user. The thickness of the impact-absorbing liner 110 typically ranges from about 20 mm to about 35 mm. In the illustrated embodiment, as shown in FIG. 2, the liner 110 comprises two complementary pieces, an upper liner 110A and a lower liner 110B, which are designed to fit together via friction fit. Specifically, as shown most clearly in FIGS. 9 and 10, the upper liner 110A comprises a plurality of notches 165 designed to mate with corresponding protrusions 170 on the lower liner 110B. The upper liner 110A and lower liner 110B are preferably designed such that a slight gap exists between the pieces when they are assembled together. This gap creates a plenum between the upper liner 110A and lower liner 110B, which acts as a pressure chamber to facilitate large volumes of airflow through the helmet 100.

In some embodiments, the exposed edges of the lower liner 110B are coated with a protective border 130 fabricated from a durable material, such as polyurethane ("PU"). The border 130 advantageously provides additional structural stability to the edges of the lower liner 110B and protects the underlying impact-absorbing material, such as EPS, from undesirable wear and tear when the helmet 100 is in use. In addition, the border 130 advantageously eliminates the need, common among conventional helmets, for a fabric liner to cover the edges of the impact-absorbing liner 110. Such fabric liners can be difficult to clean and can tend to obstruct airflow. In some embodiments, the border 130 extends to a distance of about 20 mm to about 25 mm from the nearest edge of the lower liner 110B, at a depth ranging from about 0.05 mm to about 15 mm.

In some embodiments, the helmet 100 comprises a fabric liner (not shown), sometimes referred to as a "comfort" liner, located within the impact-absorbing liner 110 such that it is adjacent to the user's head while the helmet 100 is in use. The comfort liner can attach to the impact-absorbing liner 110 using a variety of suitable attachment mechanisms, such as, for example, snaps, Velcro®, etc. The comfort liner preferably comprises a wicking fabric, such as Coolmax® performance fabric marketed by INVISTA S.A.R.L. of Wichita, Kans., which is designed to absorb perspiration generated by the user's head. The comfort liner also preferably comprises a moisture wicking foam material, having a thickness ranging from about 10 mm to about 30 mm. In operation, the comfort liner preferably absorbs and diffuses perspiration away from the user's head. In some cases, the helmet 100 comprises a second comfort liner designed for use in cold weather, which includes an outer layer of a suitable material, such as GORE-TEX® or WINDSTOPPER® marketed by W.L. Gore & Associates of Newark, Del., surrounding the moisture wicking foam and fabric layers described above.

The helmet 100 is preferably designed and constructed to meet or exceed applicable safety standards, which may vary depending on the intended use of the helmet 100, as well as the intended geographic region for use. For example, in some embodiments, the helmet 100 is designed for use in the United States by an operator or rider of a motor vehicle, such as a motorcycle or a snowmobile. In such cases, the helmet 100 is preferably designed and constructed to satisfy the safety standards established by federal and state regulatory agencies, such as the U.S. Department of Transportation (DOT), as well as the safety standards of private non-profit organizations, such as the Snell Memorial Foundation or the American National Standards Institute (ANSI). For example, in the illustrated embodiment, the helmet 100 is designed to exceed the DOT Federal Motor Vehicle Safety Standard (FMVSS) 218, as well as the Snell M2005 standard. These standards are incorporated herein by reference in their entireties.

Ventilation System

Figure 3:
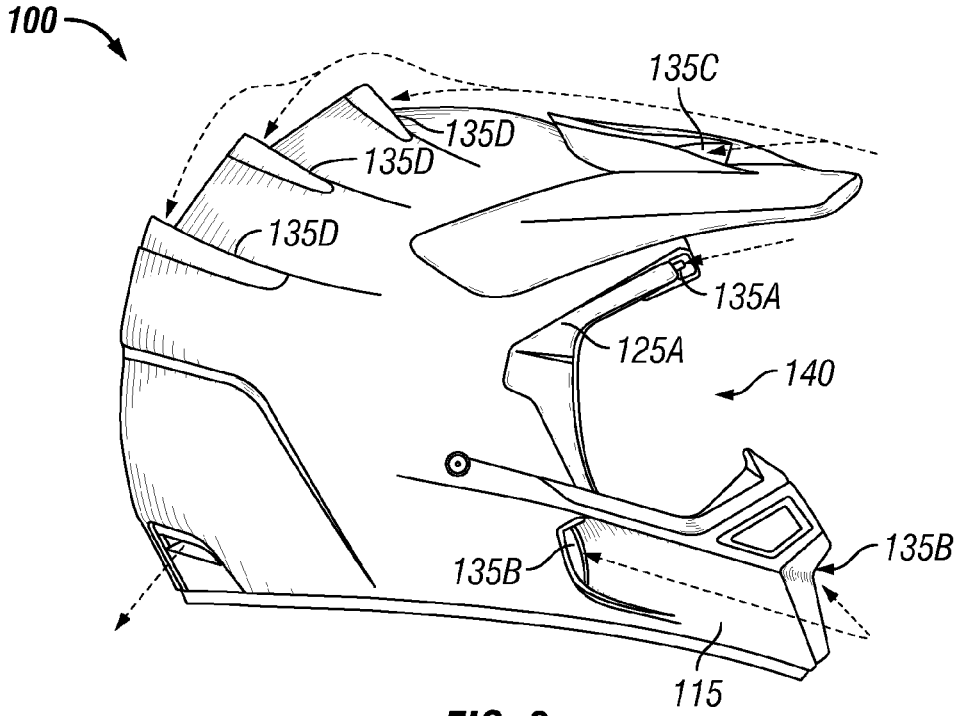
FIG. 3 is a side view of the helmet.
Figure 4:
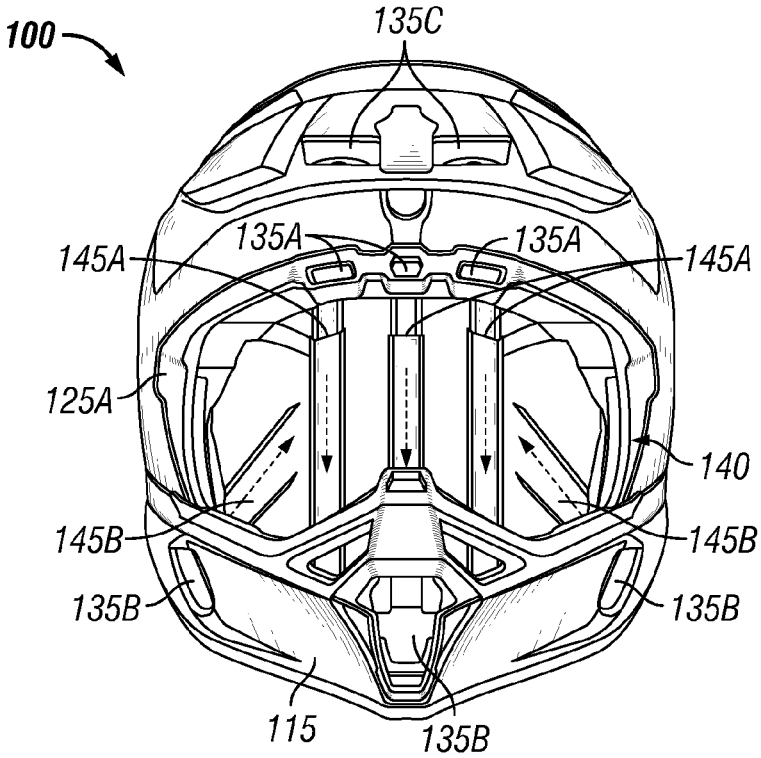
FIG. 4 is a front view of the helmet.
Figure 5:
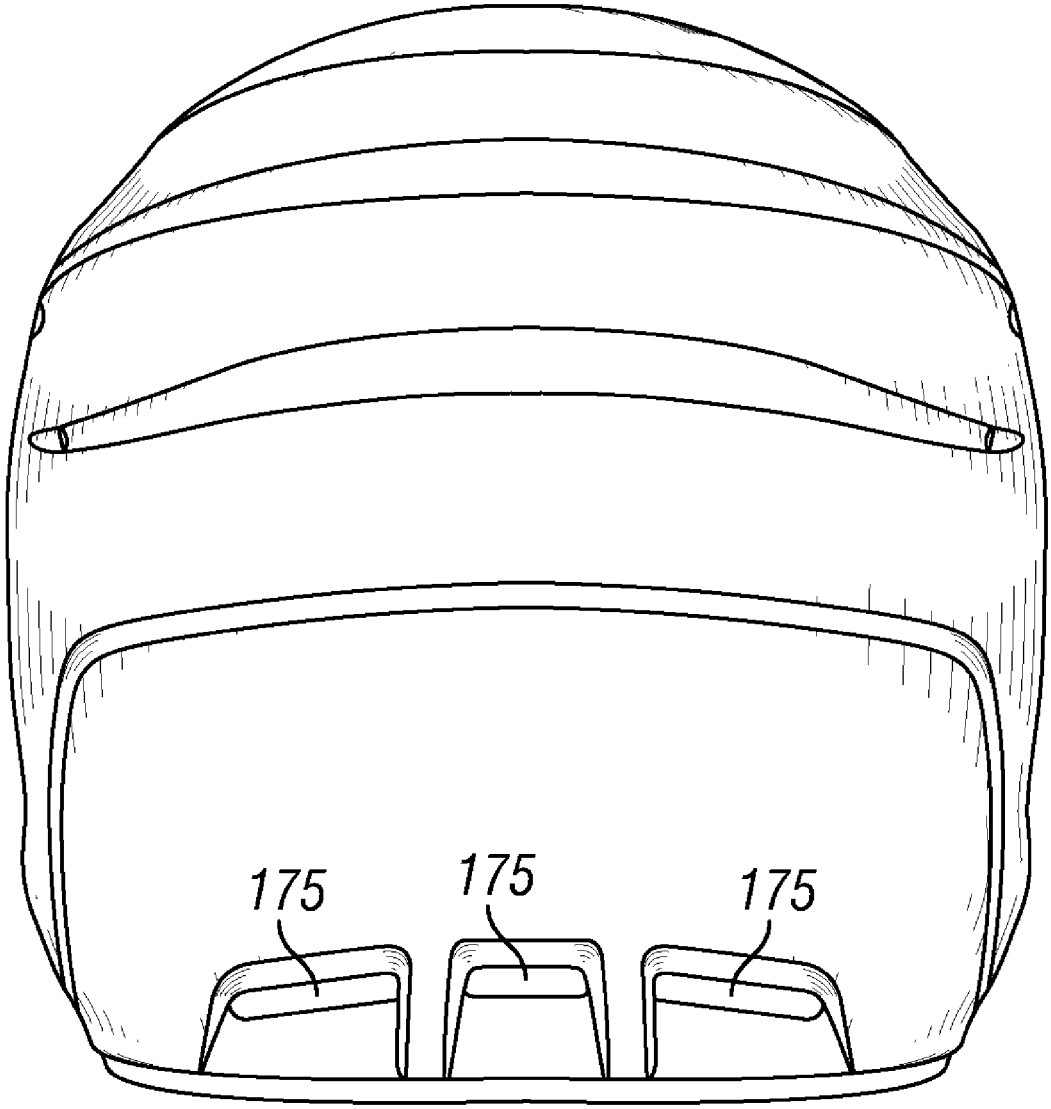
FIG. 5 is a rear view of the helmet.
Figure 6:
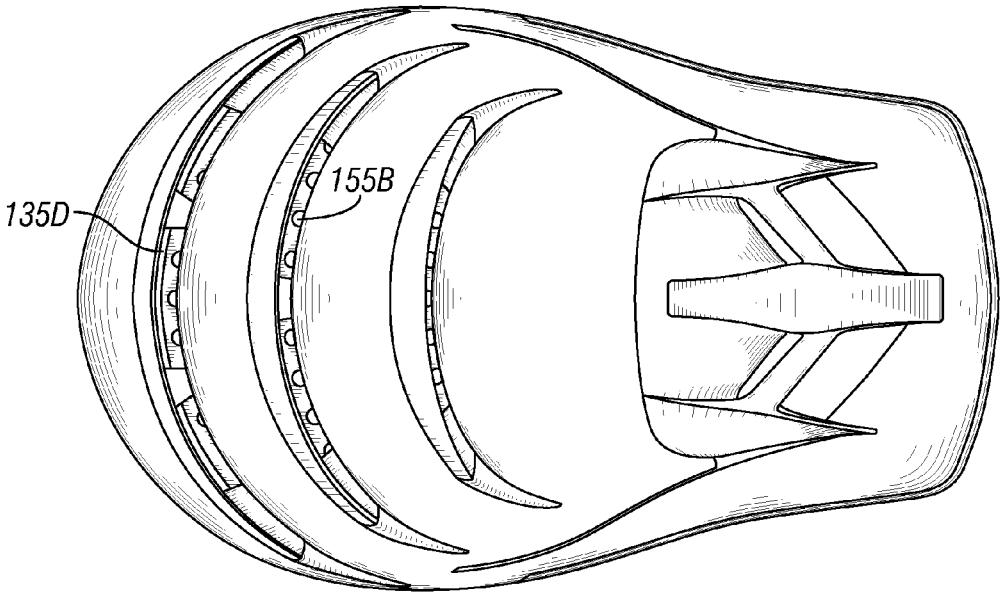
FIG. 6 is a top view of the helmet.
Figure 7:
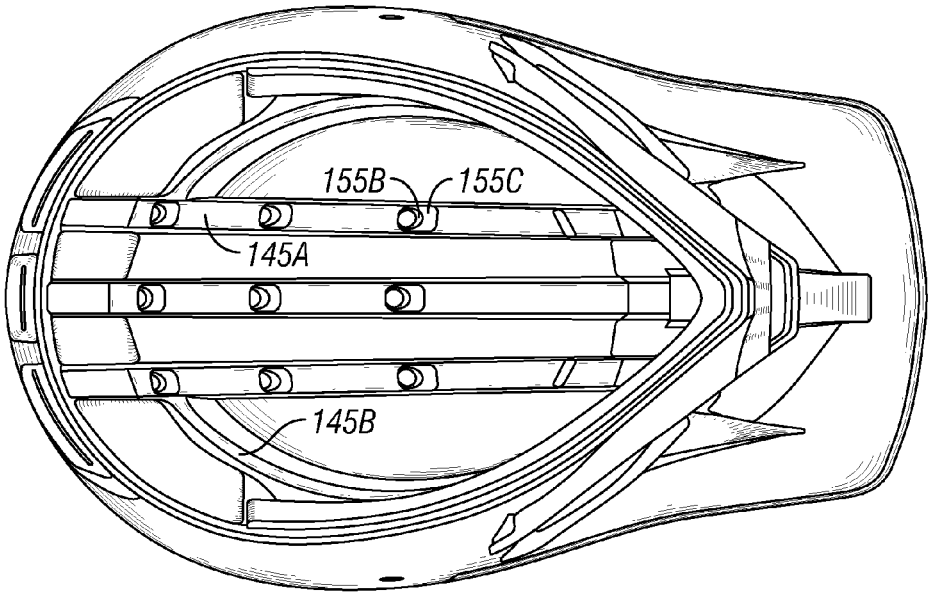
FIG. 7 is a bottom view of the helmet.
Figure 8:
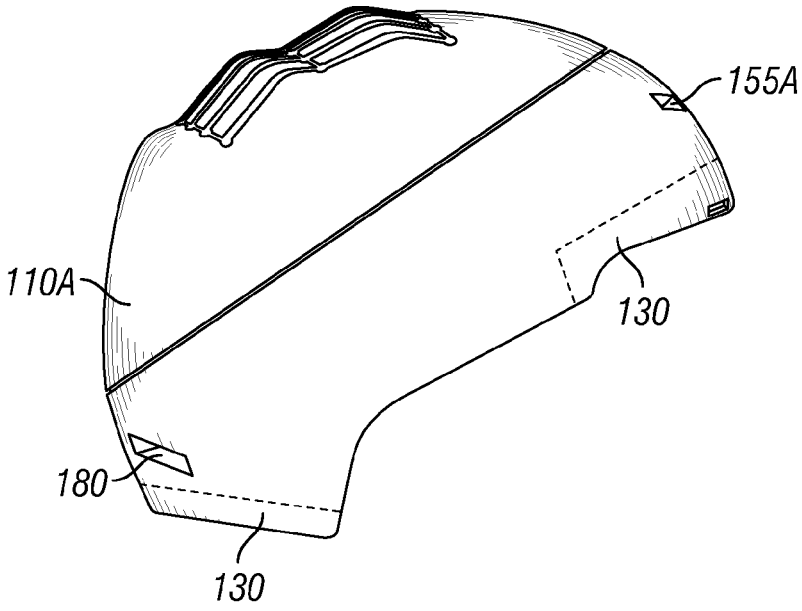
FIG. 8 is a side view of the impact-absorbing liner.
Figure 9:
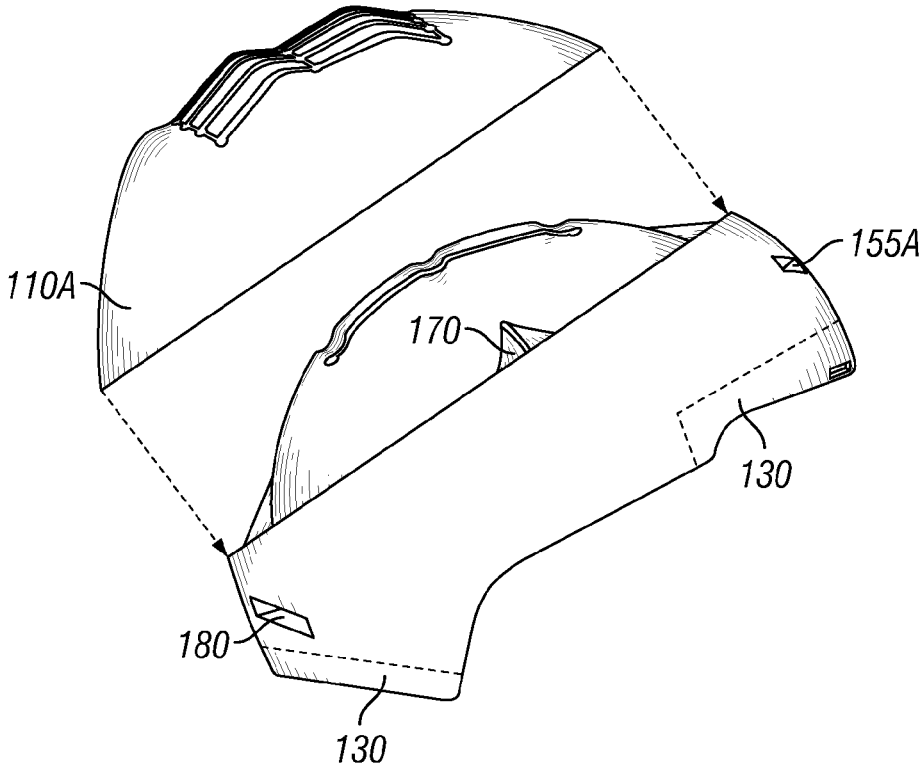
FIG. 9 is an exploded side view of the liner.
Figure 10:
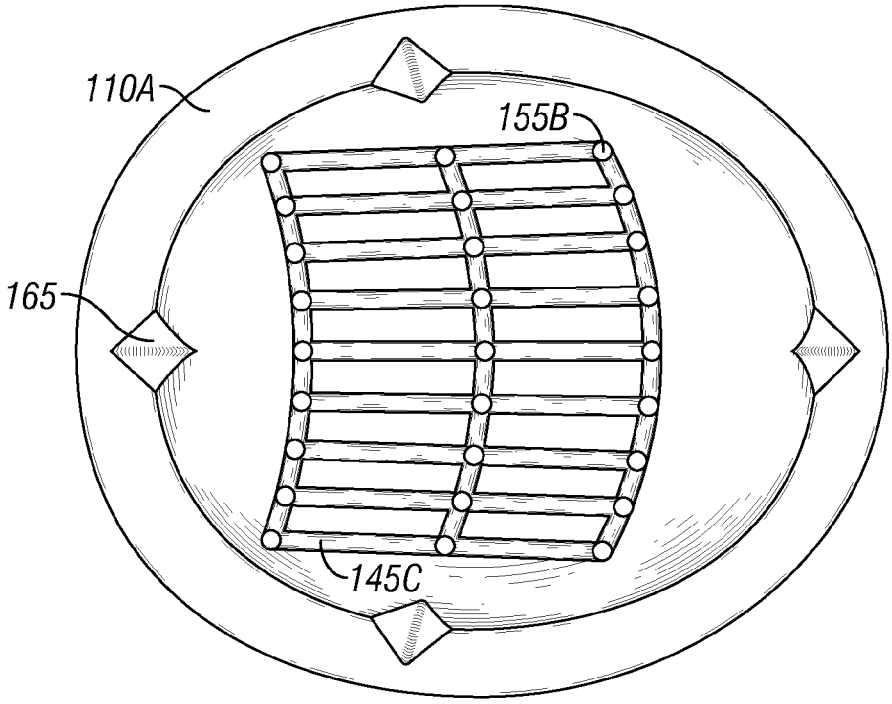
FIG. 10 is a bottom view of the upper liner.
Figure 11:
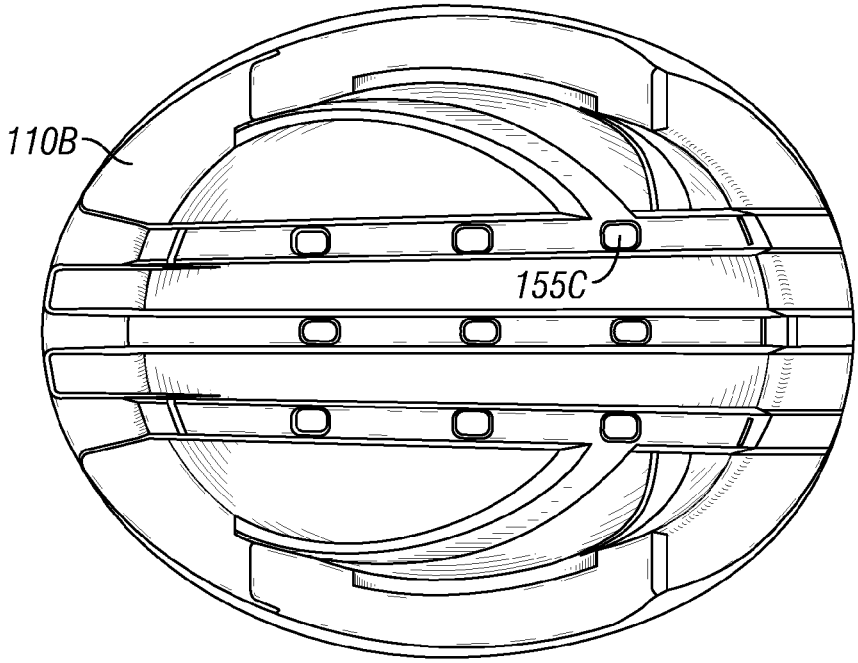
FIG. 11 is a bottom view of the lower liner.

The helmet 100 includes a ventilation system designed to substantially increase airflow through the helmet 100 while it is in use. This ventilation system is described primarily by reference to FIGS. 3 through 7, which illustrate various views of the helmet 100, as well as FIGS. 8 through 11, which illustrate various views of the impact-absorbing liner 110. Specifically, FIG. 3 is a side view of the helmet 100, FIG. 4 is a front view of the helmet 100, FIG. 5 is a rear view of the helmet 100, FIG. 6 is a top view of the helmet 100, and FIG. 7 is a bottom view of the helmet 100. FIG. 8 is a side view of the liner 110, FIG. 9 is an exploded side view of the liner 110, FIG. 10 is a bottom view of the upper liner 110A, and FIG. 11 is a bottom view of the lower liner 110B.

In the illustrated embodiment, the ventilation system of the helmet 100 comprises a forced air induction system with three subsystems: (1) an air intake subsystem, (2) an air diffusion subsystem, and (3) an air exhaust subsystem. In operation, the air intake subsystem captures large volumes of air while the helmet 100 is traveling forward, the air diffusion subsystem distributes and circulates the air around the user's head within the helmet 100, and the air exhaust subsystem allows the air to escape from the rear of the helmet 100. The ventilation system dramatically increases the amount of airflow and circulation through the helmet 100, resulting in substantially more cooling of the user's head than offered by conventional helmets.

Air Intake Subsystem

As shown most clearly in FIGS. 3 and 4, the air intake subsystem comprises a plurality of air intake vents 135 located in the outer shell 105. These air intake vents 135 can be generally categorized into four groups: (1) eye port intake vents 135A, (2) chin bar intake vents 135B, (3) forehead intake vents 135C, and (4) rear intake vents 135D.

In the illustrated embodiment, three eye port intake vents 135A are located at the top of the eye port 140 of the helmet 100. The eye port 140 is preferably designed such that a void exists between the liner 110 and the top of the goggles (not shown) that are typically worn while the helmet 100 is in use. Such a design advantageously allows the goggles to ventilate properly and reduces fogging.

In operation, forward movement creates airflow OF) through the helmet 100, indicated by the dashed arrows in the figures. As shown in FIG. 3, the eye port intake vents 135A capture the airflow AF created by forward movement of the helmet 100. Then, as shown in FIG. 4, the airflow AF captured by the eye port intake vents 135A is directed into a plurality of longitudinal channels 145A within the liner 110. In some embodiments, the eye port intake vents 135A are fabricated as part of the upper eye port trim piece 125A and have a width within the range of about 19 mm to about 27 mm, a height of about 7 mm to about 8 mm, and are spaced about 12 mm to about 15 mm apart.

In the illustrated embodiment, three chin bar intake vents 135B are located on the chin bar 115. One chin bar intake vent 135B is located near the left side, one near the right side, and one near the center of the chin bar 115. As shown in FIG. 3, the chin bar intake vents 135B capture airflow AF created by forward movement of the helmet 100. This airflow AF is then directed into side channels 145B located on both sides of the liner 110, as shown in FIG. 4. In some embodiments, the chin bar intake vents 135B have a width within the range of about 10 mm to about 15 mm and a height within the range of about 20 mm to about 32 mm.

In the illustrated embodiment, two forehead intake vents 135C are located near the center of the forehead section of the outer shell 105. These forehead intake vents 135C are preferably aligned with corresponding visor intake scoops 150 located in the visor 120 (see FIG. 2). As shown in FIG. 3, the forehead intake vents 135C capture airflow AF created by forward movement of the helmet 100. This airflow AF is directed into the plenum created by the slight gap between the upper liner 110A and lower liner 110B. As a result, much of this airflow AF is eventually directed onto the user's head via the lower air intake holes 155C located in the lower liner 110B (see FIG. 11). In some embodiments, the forehead intake vents 135C have a width within the range of about 25 mm to about 28 mm, a height of about 5 mm to about 8 mm, and are spaced about 30 mm to about 35 mm apart.

In the illustrated embodiment, the helmet 100 comprises three rear intake vents 135D, collectively referred to as an "air induction pod." The rear intake vents 135D are located in the upper rear quadrant of the helmet 100, i.e., in both the upper half and rear half of the helmet 100. As shown in FIG. 3, the rear intake vents 135D are also angled forward to capture airflow AF as it flows over the helmet 100. The captured airflow AF is directed into the plenum between the upper liner 110A and lower liner 110B via the upper intake holes 155B in the upper liner 110A (see FIG. 10). As described above, much of this airflow AF is then directed onto the user's head via the lower air intake holes 155C located in the lower liner 110B.

The amount of airflow AF captured by the rear intake vents 135D varies depending on the angle of the user's head as the helmet 100 travels forward. Thus, while using the helmet 100, users can advantageously adjust the amount of air circulation simply by tilting their head up or down, as desired. In some embodiments, each rear intake vent 135D includes a rear intake scoop trim piece 160 (see FIG. 2), which may be fabricated from a variety of suitable materials, such as plastic, and attached to the outer shell 105 behind the rear intake vents 135D using a variety of suitable mechanisms, such as pegs, screws, rivets, and/or adhesives. In some cases, certain safety standards, such as the Snell M2005 standard, require that the intake scoop trim pieces 160 be frangible, meaning that they are designed to break off easily from the outer shell 105 when subjected to sufficient force. In some embodiments, the rear intake vents 135D have a width within the range of about 47 mm to about 100 mm and are spaced about 12 mm to about 17 mm apart, and the rear intake scoop trim pieces 160 have a width within the range of about 175 mm to about 290 mm and a height within the range of about 6 mm to about 19 mm.

In addition to the air intake vents 135 located in the outer shell 105 of the helmet 100, the air intake subsystem further comprises a plurality of air intake holes 155 located within the impact-absorbing liner 110, as shown most clearly in FIGS. 8 through 11. In the illustrated embodiment, the upper liner 110A comprises two forehead intake holes 155A, which preferably align with the forehead intake vents 135C and visor intake scoops 150. As described above, the forehead intake holes 155A direct airflow AF captured by the forehead intake vents 135C into the plenum between the upper liner 110A and lower liner 110B, where it is distributed by the air diffusion subsystem. In some embodiments, the forehead intake holes 155A have a width within the range of about 15 mm to about 29 mm, a height of about 8 mm to about 12 mm, and are spaced about 33 mm to about 45 mm apart.

The upper liner 110A also comprises three curved rows with nine upper intake holes 155B each, as shown in FIG. 10. These 27 upper intake holes 155B are preferably aligned with the rear intake vents 135D, as shown most clearly in FIG. 6, and interconnected by a plurality of interior channels 145C. As a result, airflow AF captured by the rear intake vents 135D is directed into the plenum between the upper liner 110A and lower liner 110B, and distributed by the air diffusion subsystem. In some embodiments, the upper intake holes 155B are circular, having a diameter within the range of about 7 mm to about 10 mm, and are spaced about 10 mm to about 13 mm apart.

In the illustrated embodiment, the lower liner 110B comprises three curved rows with three lower intake holes 155C each, as shown in FIG. 11. These nine lower intake holes 155C are preferably aligned with the longitudinal channels 145A and with the rows of upper intake holes 155B, as shown most clearly in FIG. 7. Accordingly, airflow AF captured by the rear intake vents 135D is directed onto the user's head and into the air diffusion subsystem of the helmet 100. In some embodiments, the lower intake holes 155C are spaced about 20 mm to about 35 mm apart and have a rounded rectangular cross-section, with a length of about 15 mm to about 17 mm and a width of about 10 mm to about 13 mm.

Air Diffusion Subsystem

The ventilation system of the helmet 100 also includes an air diffusion subsystem. The air diffusion subsystem comprises a plurality of channels 145 configured to distribute air throughout the helmet 100 once it is captured by the air intake subsystem. For example, in the illustrated embodiment, the lower liner 110B comprises three longitudinal channels 145A extending substantially along its entire length. In some embodiments, the longitudinal channels 145A are spaced about 15 mm to about 17 mm apart, have a width within the range of about 15 mm to about 16 mm and a depth of about 5 mm to about 7 mm. Such longitudinal channels 145A are typically substantially deeper than similar channels in existing helmets, thus allowing higher volumes of air to flow next to the user's head when the helmet 100 is in use.

The air diffusion subsystem of the illustrated embodiment further comprises side channels 145B, which operate in conjunction with the chin bar intake vents 135B, as described above. In some embodiments, the side channels 145B have a width of about 15 mm to about 25 mm, a depth of about 3 mm to about 7 mm, and they extend from the chin bar intake vents 135B to the longitudinal channels 145A near the back of the lower liner 110B. Such side channels 145B typically carry air further into the helmet 100 than similar channels in existing helmets.

As described above, the air diffusion subsystem further comprises a plenum created by the slight gap between the upper liner 110A and lower liner 110B. In some embodiments, this plenum can act as a "pressure chamber network" due to the configuration of the upper intake holes 155B, lower intake holes 155C, and interior channels 145C. For example, in the illustrated embodiment, the upper liner 110A comprises 27 upper intake holes 155B, whereas the lower liner 110B comprises only nine lower intake holes 155C. Such a configuration creates a pressure gradient that advantageously increases the velocity of the airflow AF through the helmet 100 and forces large volumes of air deeper into the helmet 100 onto the user's head.

Air Exhaust Subsystem

The ventilation system of the helmet 100 also includes an air exhaust subsystem. In the illustrated embodiment, as shown most clearly in FIG. 5, the air exhaust subsystem comprises three exhaust ports 175 located near the lower back portion of the outer shell 105. The exhaust ports 175 are aligned with corresponding exhaust holes 180 in the lower liner 110B (see FIGS. 8 and 9). In addition, the air exhaust subsystem includes the lower rear portions of the longitudinal channels 145A, through which airflow AF can also exhaust out of the back of the helmet 100 onto the user's neck. In operation, as shown in FIGS. 3 and 4, airflow AF enters the front of the helmet 100 through the air intake subsystem and pushes through the helmet 100 via the air diffusion subsystem, helping evaporate built up perspiration and carrying off heat. The air exhaust subsystem creates a vacuum near the back of the helmet 100 that draws the airflow AF through the helmet 100 and gives the hot air a place to escape.

In some embodiments, the exhaust ports 175 have a width within the range of about 30 mm to about 50 mm, a height of about 5 mm to about 8 mm, and are spaced about 18 mm to about 23 mm apart. Similarly, the exhaust holes 180 preferably have a width of about 15 mm to about 50 mm, a height of about 9 mm to about 11 mm, and are spaced about 18 mm to about 23 mm apart. In some embodiments, the exhaust ports 175 are located within about 25 mm to about 35 mm of the bottom of the helmet 100. This low position advantageously generates more velocity and allows greater volumes of air to escape from the exhaust ports 175 than from similar ports in existing helmets.

Designers can make numerous adjustments to the ventilation system described above to optimize the ventilation characteristics of the helmet 100 for different conditions. For example, in some cases, it may be desirable to adjust the number of intake vents 135 or the size, shape or location of the intake vents 135. Numerous other adjustments to the air intake subsystem, air diffusion subsystem, or air exhaust subsystem are possible. Designers can utilize a number of well-known techniques, such as wind tunnel observation and computer simulation, to evaluate and implement such adjustments.

Although this invention has been described in terms of certain preferred embodiments, other embodiments that are apparent to those of ordinary skill in the art, including embodiments that do not provide all of the features and advantages set forth herein, are also within the scope of this invention. Rather, the scope of the present invention is defined only by reference to the appended claims and equivalents thereof.

What is claimed is:

1. A helmet comprising:

an outer shell comprising a fiber reinforced composite material;

an impact-absorbing liner within the outer shell, the liner comprising Expanded Polystyrene having a thickness of at least about 20 mm;

wherein at least one edge of the impact-absorbing liner is coated with a protective border comprising polyurethane, the protective border extending to a distance of at least about 20 mm from the nearest edge of the impact-absorbing liner, at a depth of at least about 0.05 mm; and a ventilation system comprising, an air intake subsystem comprising a plurality of air intake vents located in the outer shell and a plurality of air intake holes located in the liner;

an air diffusion subsystem comprising a plurality of channels extending throughout the liner and a plenum located between an upper portion of the liner and a lower portion of the liner, the upper portion of the liner comprising a plurality of air intake holes configured to direct airflow captured by one or more of the air intake vents into the plenum; and an air exhaust subsystem comprising at least one exhaust port located in the outer shell and a corresponding exhaust hole located in the liner.

2. The helmet of claim 1, wherein the upper portion of the liner comprises a plurality of notches and the lower portion of the liner comprises a plurality of corresponding protrusions configured to mate with the notches, such that the upper and lower portions of the liner can be attached together via friction fit.

3. The helmet of claim 1, wherein the plenum acts as a pressure chamber to forcefully direct airflow onto the user's head while the helmet is in use.

4. The helmet of claim 1, wherein the upper portion of the liner and the lower portion of the liner each comprise a plurality of rows of air intake holes aligned with a corresponding plurality of rear intake vents located in an upper rear quadrant of the outer shell.

5. The helmet of claim 1, wherein the air intake subsystem comprises a plurality of eye port intake vents, chin bar intake vents, forehead intake vents, and rear intake vents.

6. The helmet of claim 1, wherein the air diffusion subsystem comprises a plurality of longitudinal channels extending substantially along the entire length of the lower portion of the liner, the longitudinal channels having a depth of at least about 5 mm.

7. The helmet of claim 1, wherein the air diffusion subsystem comprises a plurality of side channels configured to operate in conjunction with one or more chin bar intake vents located in the outer shell, the side channels having a depth of at least about 3 mm.

8. The helmet of claim 1, wherein the air exhaust subsystem comprises a plurality of exhaust ports located in the rear of the outer shell within at least about 35 mm from the bottom edge of the outer shell, the exhaust ports being aligned with corresponding exhaust holes in the lower portion of the liner.

9. The helmet of claim 1, wherein the air exhaust subsystem includes the lower rear portions of a plurality of longitudinal channels, through which airflow can exhaust out of the back of the helmet onto the user's neck.

10. A helmet comprising:

an outer shell comprising a fiber reinforced composite material; and an impact-absorbing liner within the outer shell, the liner comprising Expanded Polystyrene having a thickness of at least about 20 mm;

wherein at least one edge of the impact-absorbing liner is coated with a protective border comprising polyurethane, the protective border extending to a distance of at least about 20 mm from the nearest edge of the impact-absorbing liner, at a depth of at least about 0.05 mm;

wherein the outer shell has a plurality of air intake vents, including one or more rear intake vents located in an upper rear quadrant of the helmet and angled forward to capture air flowing over the helmet as it travels forward;

wherein the impact-absorbing liner comprises a plurality of air diffusion channels and a plurality of air intake holes aligned with the air intake vents, and wherein the air intake vents, air intake holes, and air diffusion channels are configured to direct airflow onto a user's head while the helmet is in use.

11. The helmet of claim 10, further comprising one or more rear intake scoop trim pieces attached to the outer shell behind the one or more rear intake vents.

12. The helmet of claim 11, wherein the one or more rear intake scoop trim pieces are each frangible and have a height of at least about 6 mm.

13. The helmet of claim 10, wherein the one or more rear intake vents each have a width of at least about 47 mm.

14. The helmet of claim 10, wherein the one or more rear intake vents are configured such that users can adjust the amount of airflow captured by the rear intake vents by tilting their head up or down as the helmet travels forward.

15. The helmet of claim 10, wherein the outer shell comprises a plurality of eye port intake vents, chin bar intake vents, forehead intake vents, and rear intake vents.

16. A helmet comprising:

an outer shell comprising a fiber reinforced composite material; and an impact-absorbing liner within the outer shell, the liner comprising Expanded Polystyrene having a thickness of at least about 20 mm;

wherein at least one edge of the impact-absorbing liner is coated with a protective border comprising polyurethane, the protective border extending to a distance of at least about 20 mm from the nearest edge of the impact-absorbing liner, at a depth of at least about 0.05 mm.

17. The helmet of claim 16, wherein the helmet weighs less than about 1450 grams.

18. The helmet of claim 16, wherein the outer shell is constructed such that its thickness varies in different regions of the helmet.

19. The helmet of claim 16, wherein the impact-absorbing liner comprises an upper liner and a lower liner configured to attach together via friction fit.

* * * * *